US007017229B2

(12) United States Patent
Walcome

(10) Patent No.: US 7,017,229 B2
(45) Date of Patent: Mar. 28, 2006

(54) LATCHING DOOR STOP FOR A MARINE VESSEL

(76) Inventor: Richard Walcome, 240 Airport Rd., Port Townsend, WA (US) 98368

( * ) Notice: Subject to any disclaimer, the term of this patent is extended or adjusted under 35 U.S.C. 154(b) by 0 days.

(21) Appl. No.: 10/757,804

(22) Filed: Jan. 14, 2004

(65) Prior Publication Data

US 2004/0145193 A1 Jul. 29, 2004

Related U.S. Application Data

(60) Provisional application No. 60/440,205, filed on Jan. 14, 2003.

(51) Int. Cl.
*E05F 5/06* (2006.01)

(52) U.S. Cl. ..... 16/82; 16/85; 16/86 R; 16/DIG. 17; 292/DIG. 19; 292/DIG. 4

(58) Field of Classification Search ..... 16/82, 16/85, 86 R, 86, DIG. 18, DIG. 17; 292/DIG. 19, 292/198, 251.5
See application file for complete search history.

(56) References Cited

U.S. PATENT DOCUMENTS

| | | | | | |
|---|---|---|---|---|---|
| 905,804 | A * | 12/1908 | Fies | 292/78 |
| 1,126,836 | A * | 2/1915 | Newton | 16/85 |
| 1,309,310 | A * | 7/1919 | Voight | 292/234 |
| 1,688,221 | A * | 10/1928 | Abbey | 292/77 |
| 1,896,363 | A * | 2/1933 | Johnson | 292/99 |
| 2,872,232 | A | 2/1959 | Lawson | 292/80 |
| 3,010,142 | A | 11/1961 | Ahlquist | 16/86 |
| 3,243,836 | A | 4/1966 | Reiss | 16/85 |
| 4,134,608 | A | 1/1979 | Pool | 292/76 |
| 4,159,837 | A * | 7/1979 | Morita | 292/127 |
| D257,944 | S * | 1/1981 | Morita | D8/331 |
| 4,302,864 | A * | 12/1981 | Morita | 16/85 |
| D263,558 | S * | 3/1982 | Morita | D8/402 |
| 4,702,506 | A * | 10/1987 | Iimura | 292/251.5 |
| 4,995,655 | A | 2/1991 | Freeman | 292/251.5 |
| 5,575,514 | A | 11/1996 | Troy | 292/340 |
| 5,836,049 | A | 11/1998 | Chiang | 16/82 |
| 5,887,917 | A | 3/1999 | Luciana | 292/251.5 |
| 6,151,754 | A | 11/2000 | Chen | 16/85 |
| 6,651,295 | B1 * | 11/2003 | Hodson | 16/85 |

* cited by examiner

*Primary Examiner*—Brian E. Glessner
*Assistant Examiner*—Mark Williams

(57) ABSTRACT

The current invention discloses a wall mountable device that suitable for use on a marine vessel. The device has having a stop member with a spring biased piston and a compressible bumper covering the end of the piston. A latch is mounted on the stop. The latch is adjustable for use regardless of which way a door swings. A striker plate and a catch are mountable on a door and their angle relative to the door can be adjusted to allow the device to function where a door does to open exactly parallel to an adjacent wall. In use, the piston spring forces the bumper against the striker plate when the door is locked in the open position thereby preventing the device from rattling when the vessel is in rough water.

10 Claims, 3 Drawing Sheets

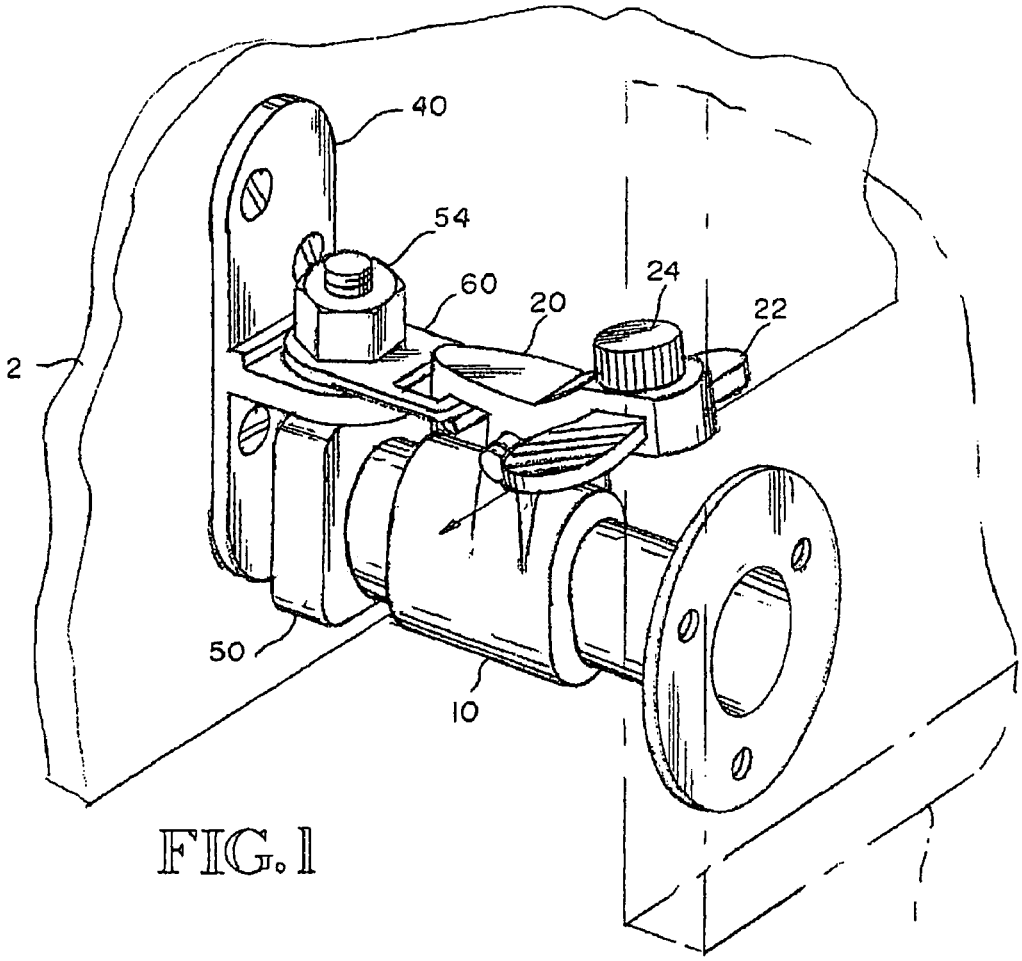
FIG. 1
FIG. 2
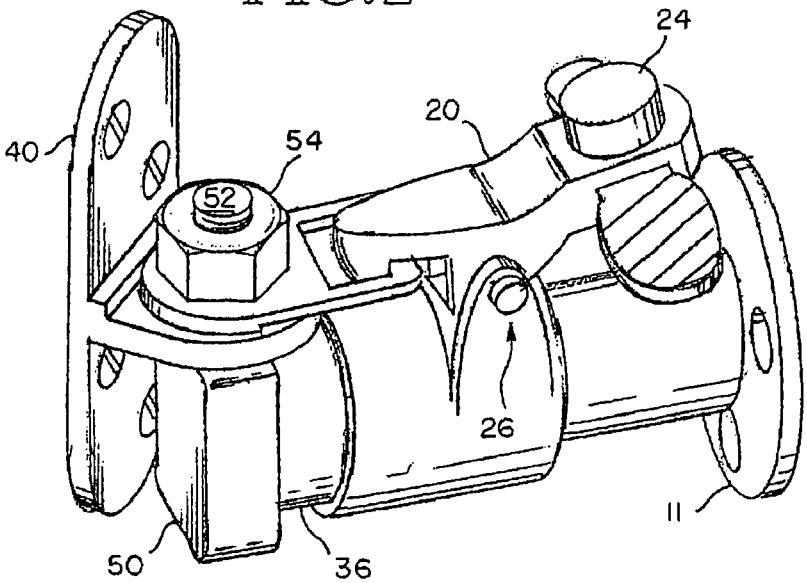

LATCHING DOOR STOP FOR A MARINE VESSEL

CROSS REFERENCE TO RELATED APPLICATION

This application claims priority from U.S. Provisional Patent Application No. 60/440,205, filed Jan. 14, 2003, entitled "Door Stop Latch."

TECHNICAL FIELD

This invention relates to door stops and door retainers, more particularly to a device for retaining a door in the open position on a marine vessel and preventing the door or the device from rattling.

BACKGROUND OF THE INVENTION

Generally, door stops are described in terms of use for doors on residential homes or commercial buildings. Originally a door was held in a fully open position by a wedge forced between the bottom of the door and the floor. Another original solution to the problem was a hook-and-eye hardware apparatus. While these devices functioned adequately to hold a door open, the wedge could cause a tripping hazard when not in use, and neither device provided the function of a door stop.

Numerous inventors have created doorstops that had an added feature of retaining a door in a fully open position. U.S. Pat. Des. No. 251,585 to Coutts (1979), U.S. Pat. No. 257,944 to Morita (1981), U.S. Pat. No. 263,558 to Morita (1982), U.S. Pat. No. 1,564,183 to Prinzler (1925), U.S. Pat. No. 1,688,221 to Abbey (1928), U.S. Pat. No. 1,941,576 to Phipps (1934), and U.S. Pat. No. 2,872,232 to Lawson (1959) disclose both floor and wall mounted door stopping and retaining devices. While these devices are suitable for use in homes and other buildings, some of them cannot be adapted for use on marine vessels.

None of the noted devices that can be adapted for use in a marine vessel address the constant rattling of the doors or hatch covers caused by the vessel crossing waves. In rough waters, the rattling can become quite intense and the forces generated by even the slightest door movements can damage a door stop or cause the stop to fail thereby allowing the door to swing freely on its hinges. Additionally, the inventions by Prinzler and Coutts require a degree of force to engage and release the components. The resistance created by pushing or pulling a door to engage or release these devices causes the door to transmit stress and twisting to its hinges, which could damage or loosen the hinges.

Both wall and floor mounted combined door stops and latching devices are of a high cost to the consumer due to their high manufacturing expense, and are difficult to install and align for the average person. When wall mounted, they will not function unless a door is parallel to a wall in its open position so that the invention meets the door at a 90-degree angle.

U.S. Pat. No. 4,134,608 to Pool (1979) discloses a combination door stop and catch; however, this invention is exposed along a door's edge and the side facing a room, when the door is retained in a fully open position. It will not function unless a door is parallel to the wall in a fully open position causing the invention to meet a door at a 90-degree angle. With continued use, the device defaces the edge and side of a door facing a room, when the door is in the fully open position. If used on a marine vessel, the device allows a door to rattle back and forth causing the same problems noted above.

Another solution to the problem was the invention of various magnetic door stops and holders. U.S. Pat. Des. No. 253,335 to Gauntner et al. (1979), U.S. Pat. No. 259,395 to Sugasawara (1981), U.S. Pat. No. 274,980 to Tomita (1984), U.S. Pat. No. 2,496,691 to Berry (1948), U.S. Pat. No. 2,815,236 to Lowinski (1957), U.S. Pat. No. 3,025,559 to Basinger (1959), U.S. Pat. No. 3,100,664 to Duval (1962), U.S. Pat. No. 3,163,453 to Stephens (1962), U.S. Pat. No. 3,244,443 to Rodgers (1966), U.S. Pat. No. 3,578,370 to Greytok (1971), U.S. Pat. No. 3,701,557 to Centofante (1972), disclose both floor and wall mounted, magnetic door stops and holders. While these devices would not allow the doors of a marine vessel to rattle, they could not hold those doors open in rough water. Additionally, the inherently brittle characteristic of magnets allowed them to break, or crumble when continually being impacted by the mass of a door.

A device disclosed in U.S. Pat. No. 5,575,514 to Troy (1996) discloses the use of hook and loop type material on a door and door stop for holding the door in an open position. While this device would be advantageous to magnet type door stops in a marine environment, it also would not hold the door open in rough water.

To overcome some of the disadvantages of door stops designed primarily for use in buildings, several door stops have been designed specifically for use in marine vessels. These devices generally comprise some sort of mechanical apparatus that has some means for latching a door in an open position. Of the devices, designed for marine use, that attempt to address the problem of a door rattling in rough water, the majority use some sort of compressible bumper between the door and the door stop.

While these devices were intended to reduce or eliminate rattling, they do not work. When devices are installed such that the bumper would reduce rattling, the bumper will not compress far enough so that the latch can function. Additionally, the bumpers can become less compressible over time or when a vessel is operated in cold environments, therefore making it difficult to latch the door in the open position.

Therefore a need exists for a door stop device that is suitable for use in a building, but can be used on a marine vessel. Such a device should be able to hold the door of a marine vessel in an open position when the vessel is in rough water. A need also exists for such a device that does not rattle when a door is held in the open position. A non-rattling marine door stop that can hold a door in an open position in cold environments and that does not lose its effectiveness over time would be an improvement over the prior art.

DISCLOSURE OF THE INVENTION

It is an object of the current invention to provide a door stop that can be used to hold a door in the open position.

Another object of the present invention is to provide a door stop that is suitable for use in buildings and on marine vessels.

A further object of the current invention is to provide a door stop that will not rattle when used on a marine vessel to hold a door in the open position while the vessel is in rough water.

It is yet another object of the current invention to provide a door stop that can be easily used in a cold environment and that will not lose effectiveness in preventing rattles over time.

Another object of the invention is to provide a door stop that can be used on doors that do not open exactly parallel to the wall on which the apparatus is mounted.

A yet further object of the current invention is to provide a door stop that can be used on doors that swing to the right of the doorway and doors that swing to the left of the doorway.

It is also an object of the current invention to provide a door stop that can be manipulated to release a door without bending over.

These and such other objects of the invention, as will become evident from the disclosure below, are met by the invention disclosed herein.

For the purposes of the disclosure herein, the latching door stop, of the current invention is describe as being mounted on a bulkhead of a marine vessel, but the term "wall" is equally suitable for describing the invention. Likewise, parts of the current invention are described as being mounted on a door, but the term "hatch cover" is equally suitable for describing the invention. Therefore, for the purposes of the description below, the term "bulkhead" should be read as including a wall and the term "door" should be read as including a hatch cover.

The current invention discloses a wall mountable door stop and latch apparatus for a marine vessel that is an essentially hollow door stop member having a piston located in the interior of the member. The piston is compressible and is spring biased outward from the end of the stop member. A bumper constructed from rubber or other compressible material covers the end of the piston.

A latch is mounted on the door stop member and the latch has a release lever that can be inserted from either side thereby making the apparatus adaptable for use regardless of which way a door swings. A striker plate and a catch member are mountable on a door by a door mounting member. The angle of the striker plate and catch member relative to the door can be adjusted thereby allowing the apparatus to function where a door does to open exactly parallel to the wall on which the stop is mounted.

The door stop member has a flanged portion and it is mounted to a wall or bulkhead in a marine vessel by a plurality of threaded fasteners. The door mounting member is mounted on an adjacent door such that it will be opposite the door stop member when the door is opened. The striker plate and the catch member are engaged with the door mounting member by a mounting post that extends from the striker. The mounting post is secured to the door mounting member by a mounting post nut.

In use, the piston spring forces the bumper against the striker plate when the latch is engaged with the catch, thereby holding the door in an open position. This prevents the apparatus or the door from rattling when used on a marine vessel that is in rough water. The latch is released from the catch by depression of a release lever. The release lever can be inserted into the latch from either side so that the door stop can be used on doors that open to the left and doors that open to the right.

BRIEF DESCRIPTION OF THE DRAWINGS

FIG. 1 is a perspective view of one preferred embodiment of the latching door stop, disclosed herein, attached to a wall and a door.

FIG. 2 is a perspective view of one preferred embodiment of the latching door stop disclosed herein.

BEST MODE OF CARRYING OUT THE INVENTION

Figure 3:
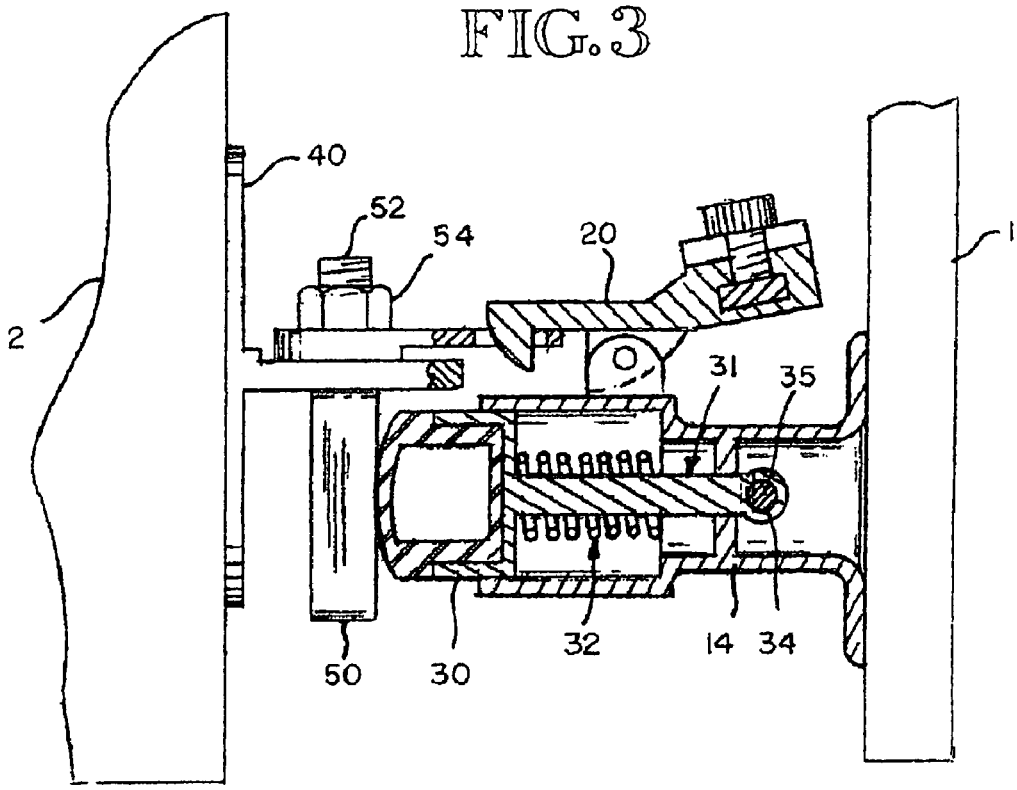
FIG. 3 is a cross-sectional side view of one preferred embodiment of the latching door stop disclosed herein.

Turning now to the drawings, the invention will be described in preferred embodiments by reference to the numerals of the drawing figures wherein like numbers indicate like parts. One preferred embodiment of the apparatus of the current invention can be seen in FIGS. 1 through 3. The door stop comprises a door stop member 10 with an interior piston 30, a latch 20, a door mounting member 40, a door stop striker plate 50, and a catch member 60.

A first end of the door stop member 10 has a flanged portion that has a plurality of holes communicating through the flange. The door stop member is attached to a bulkhead using standard fasteners, and in a preferred embodiment it is secured to a bulkhead with screws made from non-corrosive metal. In the preferred embodiment depicted, the door stop member 10 is an elongated, generally hollow member having a piston chamber and a rod chamber separated by a thin piston rod guide wall 14 that extends into the interior of the member. The piston rod guide wall 14 has a hole at the approximate center of the wall that communicates from the piston chamber to the rod chamber. While the door stop member in the embodiment depicted has an elliptical cross section, other embodiments can have circular, oval, or square cross sections.

The piston 30 has a cross-sectional shape that is identical to but transversely smaller than the shape of the door stop member 10 such that the piston can be easily inserted into the door stop member. The piston 30 has a rod that is routed through a piston compression spring 32 and the hole in the piston rod guide wall 14. The end of the piston rod has a hole 35 communicating therethrough, and a piston retention pin 34 is inserted through a hole. The pin 34 prevents the end of the piston rod from passing through the hole in the piston rod guide wall and retains the piston in the door stop member.

The end of the piston 30 that is opposite the rod has a generally cupped portion that is adapted for insertion of a compressible door bumper 36 that is configured for insertion therein. The bumper is constructed from material that can be compressed by an applied force and then return to its original shape when the force is removed. Materials such as rubber or closed cell foam are especially suitable for this purpose.

The spring 32 is a compression spring having suitable strength to bias the door stop bumper out of the second end of the door stop member. In the embodiment depicted the second end of the door stop member has a transversely larger cross section than the first end of the door stop member and the spring 32 can be compressed against the shoulder where the cross section changes size. In other preferred embodiments of the invention, the cross section is of uniform size along the length of the door stop member, and the spring can be compressed between the piston rod guide wall.

The latch 20 is mounted on the door stop member by routing a pin 26 through the mounting posts located on the top portion of the door stop member and through the mounting posts located on the latch member 20. The pin 26 is also routed through a torsion spring (not shown) that is located between the mounting posts on the latch member. The torsion spring has two legs extending therefrom such that one leg engages the top of the mounting member and the other leg engages the bottom of the latch member, thereby biasing the end of the latch member with the release lever 22 upward.

A latch nub is located at a first end of the latch member 20 The latch nub has a beveled exterior face and a flat interior face that make a right angle with the bottom of the latch member 20.

The shank end of the latch member 20 has a release lever insertion hole communicating through the member from side to side for insertion of the release lever 22. A release lever retention hole communicates from the top of the latch member into the release lever insertion hole. The release lever retention hole is threaded for engagement with the release lever retention bolt 24.

The release lever 22 can be inserted into the release lever insertion hole from either side of the latch member 20 so that it protrudes from the insertion hole on the side of the member that is opposite the hinges of the door. This allows the same door stop to be used for doors that open to the right or doors that open to the left without any major adjustments. In practice, it has been found that a preferred way to install the release lever 22 is to insert it from the side of the latch member that is opposite the hinges of a door. The release lever 22 is secured in the insertion hole by placing the threaded release lever retention bolt 24 into the release lever retention hole and tightening the bolt until the release lever is secure.

The door mounting member 40 is an essentially flat plate with a connecting portion extending from the front face of the mounting member. The mounting member 40 has a plurality of mounting holes for mounting on the door of a marine vessel. The member is generally mounted with threaded fasteners but other types of fasteners can be used as appropriate.

The connecting portion extends at a right angle from the face of the mounting member 40 after the member is attached to a door. The connecting portion has a mounting hole communicating therethrough for insertion of the striker plate mounting post 52.

In the embodiment depicted, the door stop striker plate 50 is a generally square plate with a threaded mounting post 52 extending from one side of the plate. Other embodiments of the striker plate can be rectangular or circular in shape, and one embodiment includes an arched striker plate. The mounting post 52 is routed upward through the mounting hole in the connecting portion of the door mounting member 40 and then through a mounting hole in the catch member 60. A mounting post nut 54 is threadedly engaged with the mounting post 52 and secures the striker plate 50 and catch member 60 to the door mounting member 40.

The catch member 50 rests on top of the connecting portion. The catch member 50 has a mounting hole for insertion of the mounting post 52 and a catch hole for engagement with the latch nub. The catch member 50 is generally rectangular in shape with the corners on the end of the catch member that is nearest the door being rounded so that the catch member can be rotated for engagement with the latch where a door does not open exactly parallel to the wall or bulkhead. The catch hole is sized and shaped such that the latch nub can easily fit through the catch hole.

The door stop of the current invention can be constructed from any suitable material, and for use in a marine environment non corrosive metals such as stainless steel or brass are preferred.

As will be more apparent by the description of the door stop in operation below, the door stop disclosed herein provides several advantages over the prior art in that the catch member and striker plate can be rotated so that the door stop is suitable for use where a door does not open exactly parallel to a wall. Additionally the release lever can be inserted from either side of the latch member so the door stop is suitable for use on doors that open to the right or doors that open to the left.

The door stop disclosed herein can be installed such that the release lever does not protrude past the edge of the open door and cause a tripping hazard. The use of the release lever allows the disengagement of the latch without bending over.

The piston compression spring biases the piston forward during use, thereby forcing the bumper into secure engagement with the striker plate and preventing the door stop from moving or rattling when a marine vessel is in rough water. This is a significant improvement over the prior art in that where the prior art attempted to prevent rattling by adding a rubber bumper, the tolerance between the bumper and striker plate that would still allow a latch to function were very difficult to set.

Figure 4:
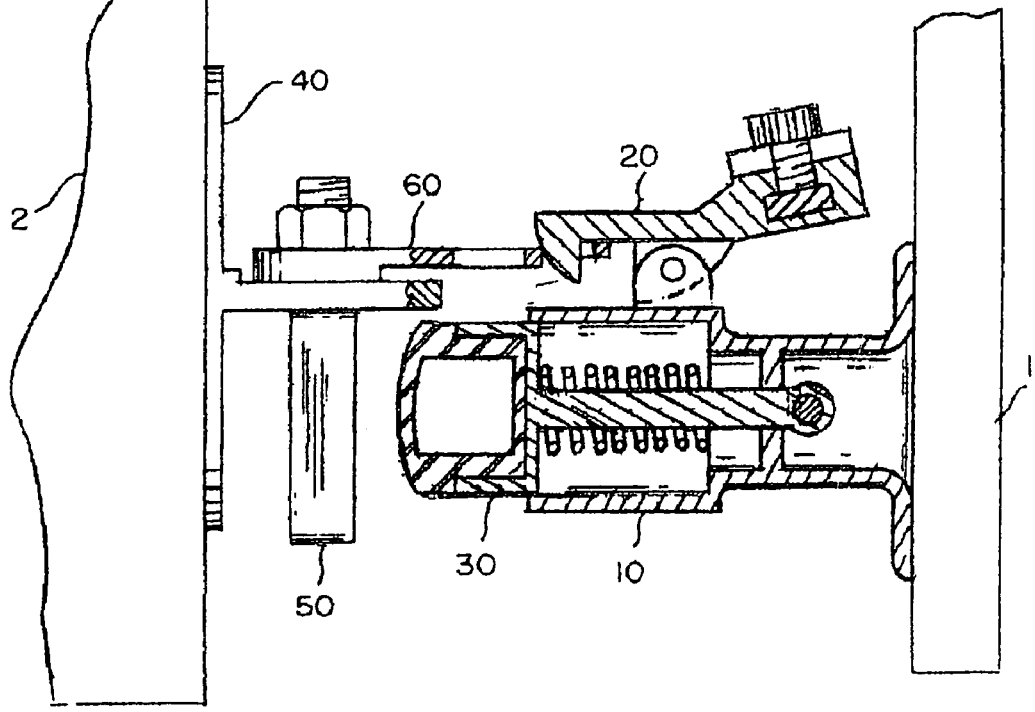
FIGS. 4 through 6 are cross-sectional side views of one preferred embodiment of the latching door stop of the current invention showing the operation of the door stop disclosed herein.
Figure 5:
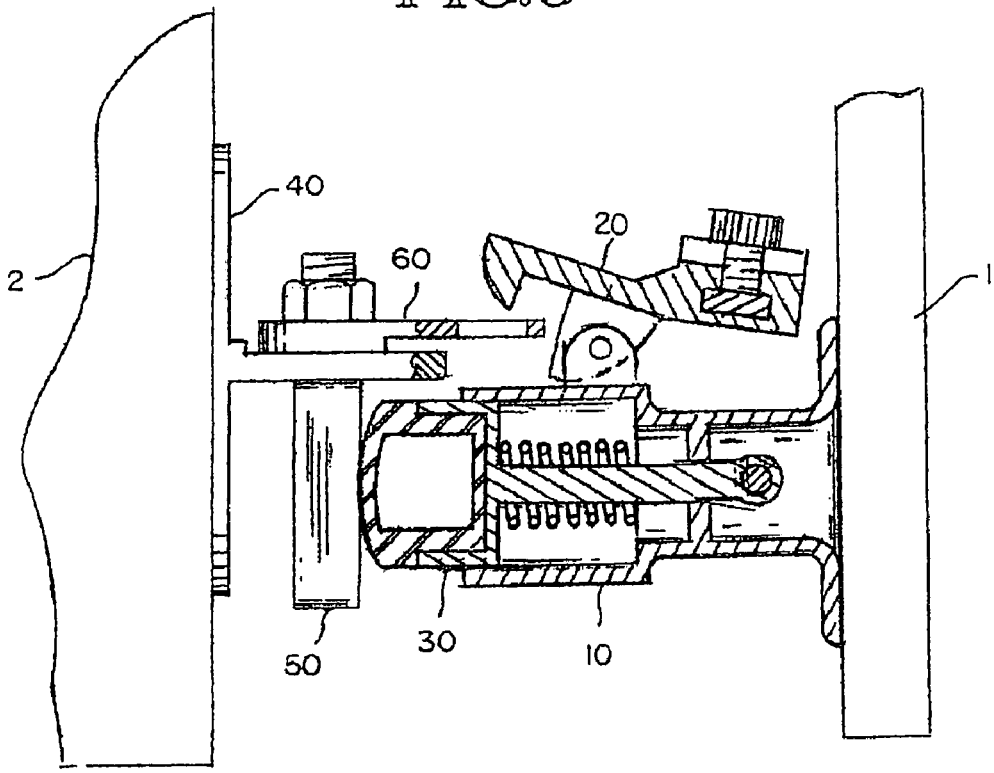
Figure 6:
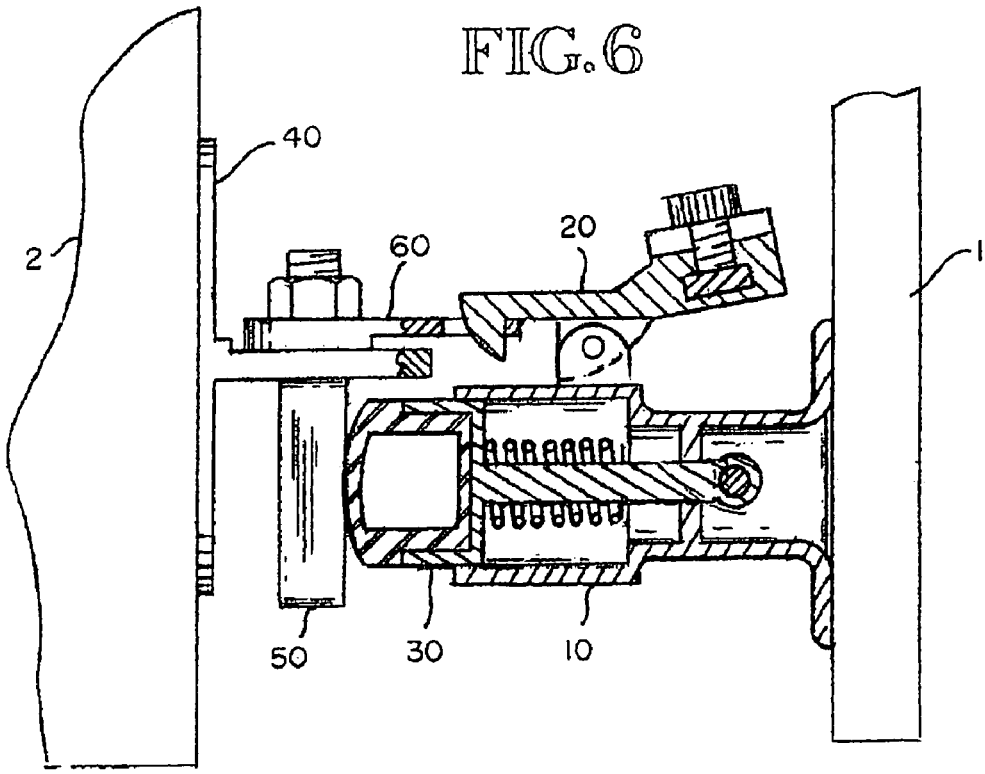

FIG. 4 through FIG. 6 depict the operation of the current invention. The door stop member 10 is mounted on a bulkhead 1 near the deck such that the release lever will be even with the edge of the door 2 when it is secured in the open position. The door stop striker plate 50 and catch member 60 are connected to the door mounting member 40. The door mounting member 40 is mounted on the door 2 so that the striker plate 50 will engage the door bumper when the door is opened. If the door 2 does not open exactly parallel to the bulkhead 1, the angle of the striker plate and the catch member are adjusted by loosening the nut on the mounting post, adjusting the catch member and striker plate as needed and tightening the mounting post nut.

Before the door is opened, the piston spring biases the piston 30 outward from the end of the door stop member 10 and the torsion spring biases the shank end of the latch member 20 upward thereby forcing the latch member to rotate about the latch fastener pin such that the latch nub is forced downward. When the door is opened and a force is applied toward the door stop member, the striker plate contacts the bumper and the leading edge of the catch member 60 contacts the beveled face of the latch nub.

As the force continues to be applied, the piston is forced into the piston cavity and the beveled face of the latch nub cams upward along the leading edge of the catch member causing the latch member to rotate about the latch fastener pin such that the shank end is forced downward. When the bottom edge of the latch nub reaches the leading edge of the catch member, the catch member slides under the latch member until the front interior edge of the catch hole is even with the back face of the latch nub.

The torsion spring then biases the shank end of the latch member upward causing the latch nub to enter the catch hole as the latch member rotates about the latch pin. When the force on the door is released, the compression spring biases the piston outward such that the bumper securely contacts the striker plate. The flat face of the latch nub is resting against the front interior edge of the catch hole such that the door is securely latched in the open position.

To close the door, a downward force is applied to the release lever causing the latch member to rotate around the latch pin and lifting the latch nub out of the catch hole. The compression spring then biases the piston to its most outward position while the catch member slides under the latch nub. When the force is released, the latch member rotates around the latch pin to its original position.

The current invention discloses a door stop that can be used to hold a door in the open position. The door stop is suitable for use on marine vessels and it will not rattle when used on a marine vessel to hold a door in the open position while the vessel is in rough water. The door stop disclosed herein can be easily used in a cold environment and will not lose effectiveness over time.

The door stop can be used on doors that do not open exactly parallel to the wall that is adjacent to the door and it can be used on doors that swing to the right of the doorway and doors that swing to the left of the doorway without major adjustments. Additionally, the door stop can be manipulated to release a door without bending over.

While the door stop member of the preferred embodiment of the invention depicted in the drawings has an elliptical cross-section, other embodiments may have oval, square, round, rectangular, or triangular cross-sections.

Additionally, while the embodiments depicted show an assembly having a striker plate and catch member that can be rotated to accommodate doors that do not open exactly parallel to the adjacent wall or bulkhead, in other embodiments the latch nub engages with a catch hole that is in the door mounting member of those embodiments. Those embodiments (not depicted in the drawings) do not have a separate striker plate and catch member. Instead, the door mounting member functions as the striker plate and catch member.

INDUSTRIAL APPLICABILITY

The door stop disclosed herein has applicability to the field of devices used for door stops and for holding doors in an open position. The door stop is suitable for use on marine vessels and it will not rattle when holding a door open when the vessel is shifting due to water conditions or other forces. The door stop can be adjusted for use on doors that open to the right or doors that open to the left, and it can be used on doors that do not open exactly parallel with an adjacent bulkhead. Unlike currently available door stops, the door stop disclosed here in will not loose effectiveness over time, and it its relatively difficult to break. The disclosed door stop is also relatively easy to install and adjust.

In compliance with the statute, the invention has been described in language more or less specific as to structural features. It is to be understood, however, that the invention is not limited to the specific features shown or described, since the means and construction shown or described comprise preferred forms of putting the invention into effect. Additionally, while this invention is described in terms of latching door stop assemblies for use on marine vessels it will be readily apparent to those skilled in the art that the invention can be adapted to other uses as well. The invention is, therefore, claimed in any of its forms or modifications within the legitimate and valid scope of the appended claims, appropriately interpreted in accordance with the doctrine of equivalents.

What is claimed is:

1. In combination, a latching door stop assembly, and a marine vessel, comprising:

a generally tubular door stop member having a first end, a second end, long axis, and a generally hollow channel communicating along the long axis therethrough;

the first end the of door stop member being connection to a bulkhead;

a door engaging member inserted into the second end of the door stop member against a spring and held therein by a retainer;

a door stop striker plate attached to said door;

a hook releaseably connecting the door stop member to the door mounting member;

wherein the generally hollow channel communicating through the door stop member has a piston chamber and a rod chamber;

the rod chamber being located at the first end of the door stop member and the piston chamber being located at the second end of the door stop member;

the piston chamber and the rod chamber being separated by a piston rod guide wall that extends into the generally hollow channel;

the piston rod guide wall has a hole in the approximate center thereof that communicates from the piston chamber to the piston rod chamber;

wherein the door engaging member is a piston inserted into the piston chamber of the door stop member;

the piston having a bumper end attaching a door bumper thereto and a rod end;

the rod end inserted through a piston compression spring, through the hole in the piston rod guide wall, and into the piston rod chamber;

the end of the rod opposite the piston having a hole communicating therethrough;

whereby when the piston is placed in the door stop member such that the piston rod is inserted through the spring, through the hole into the piston rod guide wall and into the piston rod chamber, and the retainer is inserted, the piston is retained in said guide;

the door stop member being connected to a bulkhead in a marine vessel; the door mounting member being mounted on a door adjacent the bulkhead such that it is opposite the door stop member when the door is opened; the door stop striker plate being connected to the bulkhead, and the door stop member being releasably connected to the door mounting member;

the piston compression spring biases the door bumper member into constant contact with the door stop striker plate to prevent rattling of the door;

the door stop striker plate being generally square with a threaded mounting post extending from the edge of the plate on one side thereof;

the door mounting member being generally flat with a plurality of connection holes communicating therethrough;

the door mounting member further having a flat connecting portion extending at a right angle from one surface thereof;

the connecting portion having a mounting post insertion hole communicating therethrough;

the assembly further comprising a mounting post nut, a catch member, and a plurality of threaded fasteners connecting the door mounting member to a door;

the mounting post nut in threaded engagement with the striker post; and the catch member being a generally rectangular plate having a mounting post hole communicating therethrough at one end of the long axis thereof, and a catch hole communicating therethrough at the other end of the long axis thereof, with the corners nearest the mounting hole being rounded;

whereby when the door mounting member is threadably connected to a door of a marine vessel the connecting portion extends outward from the mounting member, the mounting post of the door stop striker is placed upwardly through the mounting post hole in the connection portion and then through the mounting post hole in the catch member, the mounting post nut is placed on the mounting post and tightened, and the angle of the door stop striker plate and the catch member, relative to the door, can be adjusted for doors that do not open exactly parallel to the bulkhead to ensure that when the door is opened, one of the flat generally square surfaces of the striker plate is in contact with the door engaging member, and the catch member can be releasably engaged with the door stop member.

2. The combination of claim 1 wherein the first end of the combination member has a flanged portion with a plurality of mounting holes communicating therethrough, and the assembly further comprises a plurality of threaded fasteners.

3. The combination of claim 1 wherein the combination member has an exterior surface with a pair of latch connection posts extending therefrom;

the latch connection posts each having a hole communicating therethrough and extending from the door stop member such that the latch connection posts directly oppose each other;

the assembly further comprising a latch member, a release lever, a release lever retention bolt, a torsion spring and a latch fastener pin;

the latch member having a long axis, a top, a bottom, a shank end, a latch end, a latch nub, and a pair of stop member connection posts;

the latch nub extending downward from the bottom of the latch member at the latch end, the edge of the latch nub corresponding to the latch end having a beveled face and the edge of the latch nub, opposite edge with the beveled face, having a face that extends at a right angle from the bottom of the latch member; the stop member connection posts extending downward from the bottom of the latch member such that there is one stop member connection post on each side of the latch member and the stop member connection posts directly oppose each other; each of the stop member connection posts having a hole communicating therethrough the latch member further having a release lever insertion hole near the shank end, and a release lever retention hole near the shank end;

the release lever insertion hole communicating from one side of the latch member to the other side of the latch member at a right angle to the long axis of the latch member;

the release lever retention hole communicating from the top of the latch member into the a release lever insertion hole, the release lever retention hole being threaded;

the release lever having an insertion end and a protruding end;

the insertion end being insertable into the release lever insertion hole from either side of the latch member;

the release lever retention bolt being in threaded engagement with the release lever retention hole;

whereby when the torsion spring is placed between the stop member connection posts; the latch member is placed such that the stop member connection posts are adjacent to the latch connection posts and the torsion spring biases the shank end of the latch member upward from the door stop member; the latch fastener pin is inserted through the holes in the latch connection posts, the holes in the stop member connection posts, and the spring; the insertion end of the release lever is inserted into the release lever insertion hole such that the protruding end of the release lever is on the side of the latch mechanism that is away from the hinges of the door; the release lever retention bolt is threadedly engaged with the release lever retention hole such that the release lever is secured in the release lever insertion hole; the door or hatch cover is opened and pressure is applied to the door cover, the door stop striker plate makes contact with the door bumper and compresses the piston compression spring thereby forcing the piston further into the piston chamber while the catch member makes contact with the beveled face of the latch nub forcing the latch member upward and compressing the torsion spring, the latch nub then rides along the catch member until reaching the catch hole at which time the torsion spring biases the shank end of the latch member upward and forces the latch nub into the catch hole; and when the pressure is released from the door the piston compression spring biases the piston outward from the door stop member the face of the latch nub extending at a right angle from the bottom of the latch member is resting against the interior of the catch hole thereby locking the door in an open position.

4. The combination of claim 1 wherein the combination is constructed from a non-corrosive metal.

5. In combination, a door stop apparatus for a marine vessel comprising:

A generally tubular door stop member having a first end, a second end and a generally hollow channel communicating therethrough;

The first end of the door stop member being attached to a bulkhead in a marine vessel such that the door stop member will be opposite a door in the marine vessel when the door is open;

the door stop member having a spring biased piston retained therein such that the piston can be compressed into the second end of the door stop member;

the door stop member having a torsion spring biased latch attached there thereto;

the piston having a compressible door bumper adhered to the portion of the piston that is biased from the second end of the door stop member;

a door mounting member;

the door mounting member being attached to a door in the marine vessel such that it will be directly opposite the door stop member when the door is open;

a door stop striker plate and a catch member;

the door stop striker plate and the catch member being threadably connected to the door mounting member and to each other;

the catch member having a catch hole for engagement with the latch;

whereby when the door is opened the catch member can be releasably engaged with the latch;

the door bumper being biased against the door stop striker plate, thereby preventing the door stop from rattling when the vessel shifts due to waves or other forces;

wherein the door mounting member is generally flat with a plurality of connection holes communicating therethrough and is attached to the door by a plurality of threaded fasteners that are placed through the holes and threadably engaged with the door;

the door mounting member further having a flat connecting portion extending at a right angle from one surface thereof such that the connecting portion also extends at a right angel from the door;

the connecting portion having a mounting post insertion hole communicating therethrough;

the catch member being a generally rectangular plate having a mounting post hole communicating therethrough at one end of the long axis thereof, and a catch hole communicating therethrough at the other end of the long axis thereof, with the corners nearest the mounting hole being rounded;

the door stop striker plate having a threaded mounting post extending from the edge of the plate on one side thereof that is inserted upward through the mounting post hole in the connection portion and through the mounting post hole in the catch member;

a mounting post nut, threaded for engagement with the mounting post, and placed on the mounting post and tightened;

whereby the angle of the door stop striker plate and the catch member, relative to the door, can be adjusted for doors that do not open exactly parallel to the bulkhead to ensure that when the door is opened, on of the flat generally square surfaces of the striker plate is in contact with the door bumper, and that the catch member can be engaged by the latch.

6. The combination of claim 5 wherein the first end of the combination member has a flanged portion with a plurality of holes communicating therethrough, and the door stop member is attached to the bulkhead by a plurality of threaded fasteners that are placed through the holes and threadably engaged with the bulkhead.

7. The door stop of claim 5 wherein the generally hollow channel communicating through the door stop member has a piston chamber and a rod chamber;

the rod chamber being located at the first end of the door stop member and the piston chamber being located at the second end of the door stop member;

the piston chamber and the rod chamber being separated by a piston rod guide wall that extends into the generally hollow channel; and the piston rod guide wall has a hole in the approximate center thereof that communicates from the piston chamber to the piston rod chamber.

8. The combination of claim 7 wherein the piston has a bumper end configured for attaching the door bumper thereto and a rod end with a slender rod extending therefrom;

the rod being inserted through a piston compression spring, through the hole in the piston rod guide wall, and into the piston rod chamber;

the end of the rod opposite the piston having a hole communicating therethrough for insertion of a piston retention pin; and the piston is retained in the door stop member by a piston retention pin that is inserted through the piston rod such that the pin cannot travel through the hole in the piston rode guide wall.

9. The combination of claim 5 wherein the combination member has an exterior surface with a pair of latch connection posts extending therefrom;

the latch connection posts each having a hole communicating therethrough and extending from the door stop member such that the latch connection posts directly oppose each other the latch has a latch member, a release lever, a release lever retention bolt, a torsion spring and a latch fastener pin;

the latch member having a long axis, a top, a bottom, a shank end, a latch end, a latch nub, and a pair of stop member connection posts;

the latch nub extending downward from the bottom of the latch member at the latch end, the edge of the latch nub corresponding to the latch end having a beveled face and the edge of the latch nub, opposite edge with the beveled face, having a face that extends at a right angle from the bottom of the latch member; the stop latch member and the stop member connection posts directly oppose each other;

each of the stop member connection posts having a hole communicating therethrough;

the latch member further having a release lever insertion hole near the shank end, and a release lever retention hole near the shank end;

the release lever insertion hole communicating from one side of the latch member to the other side of the latch member at a right angle to the long axis of the latch member;

the release lever retention hole communicating from the top of the latch member into the release lever insertion hole, the release lever retention hole being threaded;

the release lever having an insertion end and a protruding end;

the insertion end being insertable into the release lever insertion hole from either side of the latch member;

the release lever retention bolt being threaded for engagement with the release lever retention hole;

the torsion spring being positioned between the stop member connection posts; the latch member being placed such that the stop member connection posts are adjacent to the latch connection posts and the torsion spring biases the shank end of the latch member upward from the door stop member; the latch fastener pin is inserted through the holes in the latch connection posts, the holes in the stop member connection posts, and the spring; the insertion end of the release lever is inserted into the release lever insertion hole such that the protruding end of the release lever is on the side of the latch mechanism that is away from the hinges of the door; the release lever retention bolt is threadably engaged with the release lever retention hole such that the release lever is secured in the release lever insertion hole;

whereby when the door or hatch cover is opened and pressure is applied to the door or hatch cover, the striker plate makes contact with the door bumper thereby forcing the piston further into the door stop member while the catch member makes contact with the beveled face of the latch nub forcing the first end of the latch member upward and compressing the torsion spring, the latch nub then rides along the catch member until reaching a catch hole at which time the torsion spring biases the shank end of the latch member upward and forces the latch nub into the catch hole; and when the pressure is released from the door the piston compression spring biases the piston outward from the first end of the stop member the face of the latch nub extending at a right angle from the bottom of the latch member is resting against the front interior edge of the catch hole thereby locking the door in an open position.

10. The combination of claim 5 wherein the combination is constructed from a non-corrosive metal.

* * * * *